US006757506B2

(12) United States Patent
Kahn

(10) Patent No.: US 6,757,506 B2
(45) Date of Patent: Jun. 29, 2004

(54) MEDIA CLEARANCE MEMBER

(75) Inventor: Arthur H. Kahn, Cohocton, NY (US)

(73) Assignee: Xerox Corporation, Stamford, CT (US)

( * ) Notice: Subject to any disclaimer, the term of this patent is extended or adjusted under 35 U.S.C. 154(b) by 76 days.

(21) Appl. No.: 10/157,247

(22) Filed: May 28, 2002

(65) Prior Publication Data

US 2003/0223778 A1 Dec. 4, 2003

(51) Int. Cl.[7] ..... G03G 15/20; B65H 3/44
(52) U.S. Cl. ..... 399/124; 271/9
(58) Field of Search ..... 399/107, 124, 399/323, 398, 399; 271/9, 307, 308, 311, 312, 313, 900

(56) References Cited

U.S. PATENT DOCUMENTS

| | | | | |
|---|---|---|---|---|
| 3,819,266 A | | 6/1974 | Price | 355/64 |
| 3,944,794 A | | 3/1976 | Reehil et al. | 235/92 SB |
| 4,231,567 A | | 11/1980 | Ziehm | 271/259 |
| 4,526,464 A | | 7/1985 | Milillo | 355/3 SH |
| 4,872,659 A | * | 10/1989 | Kato et al. | 271/9 |
| 5,623,720 A | | 4/1997 | Howe et al. | 399/323 |
| 5,732,620 A | | 3/1998 | Christy et al. | 100/80 |
| 5,802,434 A | * | 9/1998 | Takehara et al. | 399/323 |
| 5,840,003 A | | 11/1998 | Meetze, Jr. et al. | 493/405 |
| 6,003,864 A | | 12/1999 | Kuo et al. | 271/272 |
| 6,010,127 A | | 1/2000 | DiCesare et al. | 271/259 |
| 6,343,786 B1 | | 2/2002 | Gregoire et al. | 271/273 |

FOREIGN PATENT DOCUMENTS

| | | |
|---|---|---|
| EP | 0 278 237 A1 | 8/1988 |
| EP | 0 872 778 A1 | 10/1998 |
| JP | 07032111 | 3/1996 |

OTHER PUBLICATIONS

European Search Report 03253094. 1–2209, dated Nov. 12, 2003.

* cited by examiner

*Primary Examiner*—Hoan Tran
(74) *Attorney, Agent, or Firm*—Andrew D. Ryan

(57) ABSTRACT

A media clearance apparatus including a member having a length, a thickness, and a width, and a first end and a second end. The member is securable along a portion of the member to a secondary member and is functionally operational such that one end of the member is movable from a first position out of contact with a media path into a second position in contact with the media path.

22 Claims, 2 Drawing Sheets

MEDIA CLEARANCE MEMBER

FIELD OF THE INVENTION

The invention relates to copiers and printers, and more particularly, to an improved apparatus and method for use in the clearance of jammed media sheets.

BACKGROUND OF THE INVENTION

Paper jams have long been a burden to users of copiers and printers. When a paper jam occurs, the user is required to take some action to restore the system to working order and to recover the integrity of the particular job. Various strategies and features have been developed to reduce the occurrence of jams and to minimize the burden on the user to recover from the jam. However, there is still a need for an improved and efficient jam clearance system.

Reference is made to systems relating to jam clearance including U.S. Pat. Nos.; 3,819,266; 3,944,794; 4,231,567; 5,623,720; 5,732,620; 5,840,003; 6,003,864 and 6,010,127.

All documents cited herein, including the foregoing, are incorporated herein by reference in their entireties.

SUMMARY OF THE INVENTION

In an embodiment, there is provided a media clearance apparatus including a member having a length, a thickness, and a width, and a first end and a second end. The member is securable along a portion of the member to a secondary member and is functionally operational such that a portion of the member is movable from a first position out of contact with a media path into a second position in contact with the media path.

In another embodiment, there is provided a media clearing member in an electrophotographic apparatus including a member functionally associated with a media path having at least one curve. The member includes a length, a thickness, and a width, and a first end and a second end. The member is securable to a part of the electrophotographic apparatus. The member functionally operates such that one of the first end and the second end of the member is movable from a first position to a second position causing the other of the first end and the second end to move from a first position out of contact with the media path into a second position in contact with the media path. The member is not straight between the first end and the second end.

In yet another embodiment, there is provided an electrophotographic apparatus including at least one media path and a member. The member is functionally associated with the at least one media path. The member has a length, a thickness, and a width, and a first end and a second end. The member is securable to a part of the electrophotographic apparatus and adapted such that one of the first end and the second end of the member is movable from a first position to a second position causing the other of the first end and the second end to move from a first position out of contact with the media path into a second position in contact with the media path.

In another embodiment, there is provided a method of clearing media from a media path in an electrophotographic apparatus comprising: moving a first member functionally associated with a second member in the electrophotographic apparatus such that a free end of the second member intersects a portion of a media path and contacts the media causing movement of a portion of the media out of the media path; and removing the media from the media path.

Still other aspects and advantages of the present invention and methods of construction of the same will become readily apparent to those skilled in the art from the following detailed description, wherein embodiments are shown and described, simply by way of illustration. As will be realized, the invention is capable of other and different embodiments and methods of construction, and its several details are capable of modification and interchangeability in various respects, all without departing from the invention. Accordingly, the drawing and description are to be regarded as illustrative in nature, and not as restrictive.

DETAILED DESCRIPTION OF THE INVENTION

While the principles and embodiments of the present invention will be described in connection with a printer or copying device such as an analog or digital electrophotographic apparatus, it should be understood that the present invention is not limited to that embodiment or to that application. Therefore, it should be understood that the principles of the present invention and embodiments extend to all alternatives, modifications, and equivalents thereof.

Figure 1:
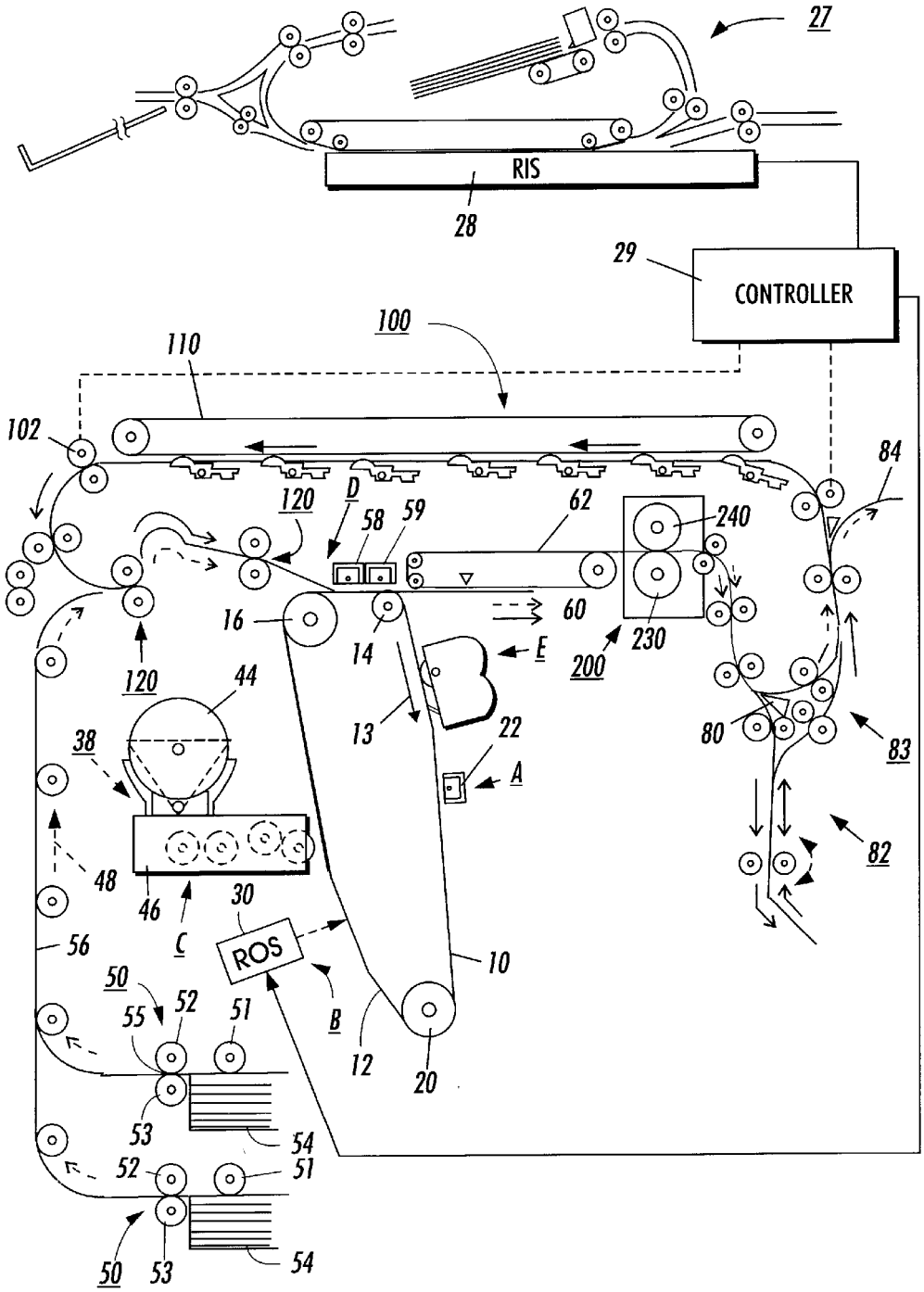
FIG. 1 is a schematic elevation view of an embodiment of an electrophotographic apparatus incorporating the media clearance member.

Referring to FIG. 1 of the drawings, schematically illustrated is an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

An electrophotographic printing or copying machine may generally include a photoconductive belt 10. The photoconductive belt 10 may be made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

After the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F of the invention herein, described in detail below.

Fusing station includes a fuser assembly 200 which permanently affixes the transferred toner powder image to the copy sheet. Fuser assembly 200 may include a heated fuser roller 240 and a pressure roller 230 with the powder image on the copy sheet contacting fuser roller 240. The pressure roller is loaded against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 240. Or alternatively, release agent is stored in a presoaked web (not shown) and applied to the fuser roll 240 by pressing the web against fuser roll 240 and advancing the web at a slow speed.

The sheet then passes through fuser 200 where the image is permanently fixed or fused to the sheet. After passing through fuser 200, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser assembly 200 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
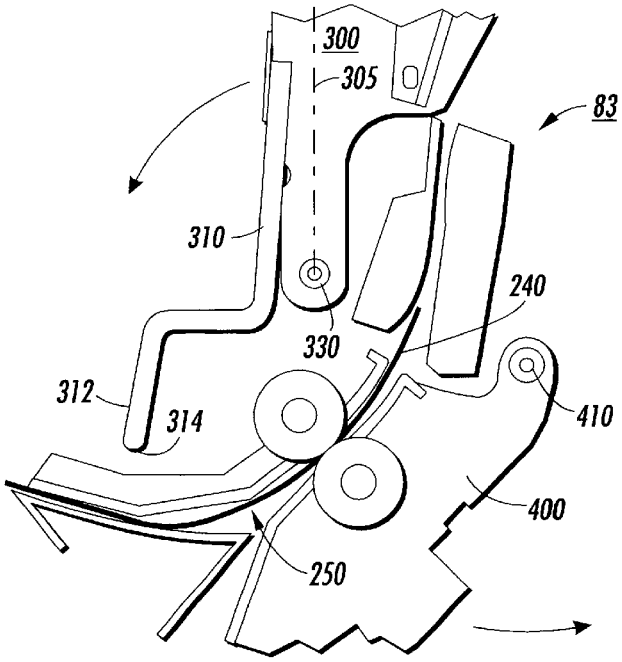
FIG. 2 is a side view of an assembly including an embodiment of the media clearance member in a first position.
Figure 3:
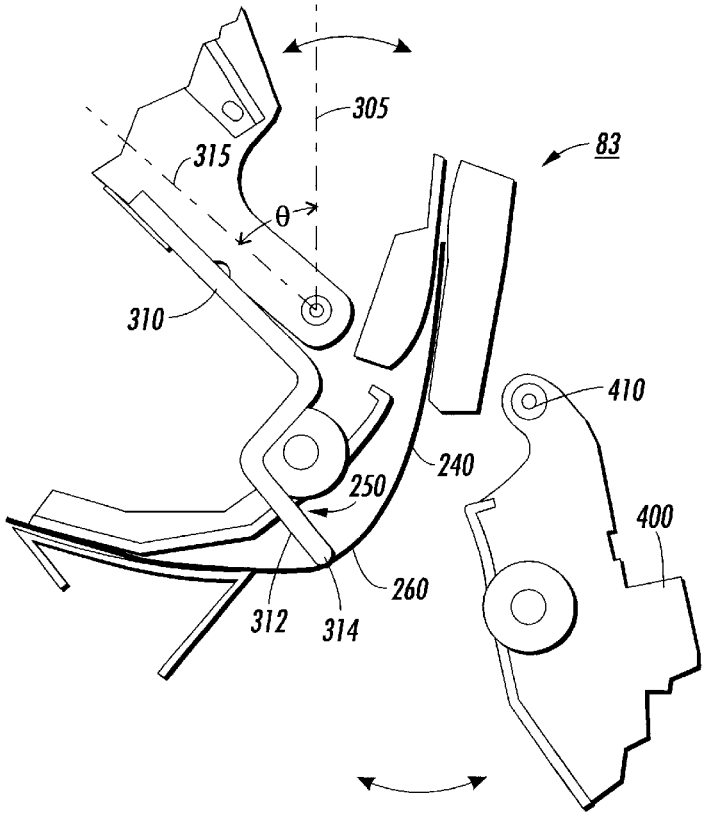
FIG. 3 is a side view of an embodiment of media clearance member in a second position.

Referring to FIGS. 2–3, a media clearance member 310 is illustrated in a portion of a media transport assembly 83 of an electrophotographic apparatus. The media clearance member 310 is used to improve both visual and physical access to the sheets in the event of a jam. The media clearance member 310 addresses two important aspects of jam clearance: (1) moving the media to a position where it can be seen by an operator; and (2) providing improved access to the media for easy removal of the media. Jammed sheets in curved paper path regions can be particularly difficult to clear and/or detect due to the media hugging the inside radius of a media path and transport baffle, for example, when the media sheet is in a nip region before and after the media path turn. In embodiments, the media clearance member 310 provides efficient media jam clearance.

FIG. 2 illustrates a media sheet 240 which has stopped and become jammed in the media path 250. The media clearance member 310 is attached to a baffle assembly 300. A baffle assembly 400 is shown on the opposite side of the media path. The baffle assemblies 300, 400 are both shown in a closed position in FIG. 2 and in an open position in FIG. 3. In use, the baffle assembly 400 is first moved to an open position as shown in FIG. 3 and then the baffle assembly 300 is then moved to a maximum open position indicated by imaginary line 315 from closed position indicated by imaginary line 305. The baffle assembly 400 may pivot about a pivot point 410. In the process of opening the baffle assembly 300 away from the closed position 305, the attached media clearance member 310 also moves and an end 314 of the media clearance member 310 enters the media path 250 and contacts the media 240. As the baffle assembly 300 is further moved toward its most open position 315, the end 314 is further moved and extends further into the media path 250 and then may extend out of the media path 250 onto the opposite side of the media path 250 into an open region where a portion of the baffle assembly 400 was once positioned when in a closed position (See FIG. 2). With movement, the end 314 pushes on the media sheet 240, causing and forming a bulge 260 out of the normal media path region, which allows for improved visibility and accessibility of the media 240 for jam clearance. The baffle assembly 300 and media clearance member 310 may angularly rotate an angle θ in a range up to 120 degrees from position 305 up to position 315.

In embodiments, the media clearance member 310 may include an offset portion or a curved portion and form a finger-like portion 312. The media clearance member 310 may be secured to a secondary member such as an aluminum extrusion or a rail of a baffle assembly 300 using a fastener such as a plastic or metal screws, adhesives, welding, or other chemical or thermal attachment methods or systems. The baffle assembly 300 may pivot from the closed position 305 to an open position 315 about a pivot point 330. The media clearance member 310 may be made from a metal or a plastic, for example, the media clearance member 310 may be made of a molded ABS plastic or a sheet metal having a length and a width and a shape sufficient to extend into the media path 250 when moved a selected angular distance. The media clearance member 310 may be straight, jogged, or offset, and the cross-section thereof may be round, square, or non-circular. The media clearance member 310 may include a diameter along a portion of its length. The media clearance member 310 may have an overall length up to 12 inches and a diameter up to 1 inch; in an embodiment, the finger portion 312 may be about 2½ inches and have a diameter of about 0.2362 inches. The media 240 may include paper or a transparency. The media path 250 may be curved including an S shaped curve. The media clearance member 310 may be associated with a media path 250 at a location thereof where there is a radius or curve, for example, an inside radius at a nip region located before and after the turn in the media path 250 or at an inverter portion of the media path 250. The media clearance member 310 may function as a mechanism for pushing and moving the media 240 away from a surface and creating a bulge 260 in the media 240 to allow greater visibility and access of the media 240 to an operator. The bulge 260 may be formed such that a concave surface of the media 240 is closest to the media clearance member 310.

In summary, the media clearance member 310 is adapted to aid in the movement of the media 240 out of a media path 250 and position the media 240 for easier retrieval by an operator. Removal of the media 240 from the electrophotographic apparatus may be a manual hand operation performed by the operator.

Other modifications may occur to those skilled in the art subsequent to a review of the present application, and these modifications, including equivalents thereof, are intended to be included within the scope of the present invention. Moreover, it is evident that many alternatives and variations thereof will be apparent to those skilled in the art. Accordingly, it is intended to embrace all such alternatives, modifications, and variations and their equivalents.

What is claimed:

1. A media clearance apparatus comprising:

a member having a length, a thickness, and a width, and a first end and a second end, the member securable along a portion of the member to a secondary member and is functionally operational such that one end of the member is movable from a first position out of contact with a media path into a second position in contact with the media path wherein the second end of the member is responsive to movement of the secondary member as the secondary member angularly rotates about an axis and wherein the second end of the member is adapted to move across the media path and push on a portion of a media causing a portion of the media to move out of the media path in a direction away from the secondary member to an opposite side of the media path.

2. The media clearance apparatus of claim 1 wherein the second end of the member is movable into contact with a media in the media path causing a portion of the media to bulge out of the media path.

3. The media clearance apparatus of claim 1 wherein the member includes at least one of an offset portion and curved portion.

4. The media clearance apparatus of claim 1 wherein the member is secured to the secondary member using a fastener.

5. The media clearance apparatus of claim 1 wherein the member is made from at least one of a metal and plastic.

6. The media clearance apparatus of claim 1 wherein the member includes a diameter along a portion of its length.

7. The media clearance apparatus of claim 1 wherein the media includes at least one of a paper and a transparency.

8. The media clearance apparatus of claim 1 wherein the media path is curved.

9. The media clearance apparatus of claim 1 wherein the member is associated with media path at a portion of the media path including a radius.

10. The media clearance apparatus of claim 1 wherein the member is a media moving mechanism for pushing the media away from a surface and for creating a bulge in the media to allow visibility and access of the media.

11. The media clearance apparatus of claim 1 wherein the member is adapted to aid in the movement of the media out of a media path and position the media for easier retrieval.

12. The media clearance apparatus of claim 1 wherein the member contacts the media after angular rotation of the member in a range up to 120 degrees.

13. The media clearance apparatus of claim 1 wherein the member contacts the media in the inverter portion of the media path.

14. The media clearance apparatus of claim 1 wherein a portion of the member is adapted to move through an opening in the media path and push on the mediastopped in the media path, causing a bulge to form in the media.

15. The media clearance apparatus of claim 14 wherein the bulge in the media is formed such that a concave surface of the media is closest to the member.

16. A media clearing member in an electrophotographic apparatus comprising:

a member functionally associated with a media path having at least one curve, the member having a length, a thickness, and a width, and a first end and a second end, the member securable to a part of the electrophotographic apparatus wherein the member functionally operates such that one of the first end and the second end of the member is movable from a first position to a second position causing the other of the first end and the second end to move from a first position out of contact with the media path into a second position in contact with the media path wherein the member is not straight between the first end and the second end wherein the second end of the member is responsive of the secondary member as the secondary member angulary rotates about an axis and wherein the second end of the member is adapted to move into the media path and push on a portion of the media causing a portio of the media to move out of the media path in direction away from the secondary member to an opposite side of the media path.

17. An electrophotographic apparatus comprising:

at least one media path;

a member functionally associated with the media path, the member having a length, a thickness, and a width, and a first end and a second end, the member securable to a part of the electrophotographic apparatus and adapted such that one of the first end and the second end of the member is movable from a first position to a second position causing the other of the first end and the second end to move from a first position out of contact with the media path into a second position in contact with the media path wherein the second end of the member is responsive to movement of the secondary member as the secondary member angulary rotates about an axis wherein the second end of the member is adapted to move into the media path and push on a portion of the media causing a portion of the media to move out of the media path in a direction away from the secondary member to an opposite side of the media path.

18. The electrophotographic apparatus of claim 17 wherein one of the first end and the second end is adapted to contact a media in the media path and moves at least a portion of the media out of the media path.

19. The electrophotographic apparatus of claim 17 further comprising at least one baffle assembly wherein the member is attached to one baffle assembly.

20. The electrophotographic apparatus of claim 19 wherein the at least one baffle assembly is movable to an open position.

21. The electrophotographic apparatus of claim 20 wherein the member is situated at an inside radius at a nip region located before and after a turn in the media path.

22. A method of clearing media from a media path in an electrophotographic apparatus comprising:

moving a first member functionally associated with a second member in the electrophotographic apparatus such that a free end of the second member intersects a portion of a media path and contacts the media causing movement of a portion of the media out of the media path; and removing the media from the electrophotographic apparatus.

* * * * *